US008130162B2

(12) United States Patent
Kildal

(10) Patent No.: US 8,130,162 B2
(45) Date of Patent: Mar. 6, 2012

(54) BROADBAND MULTI-DIPOLE ANTENNA WITH FREQUENCY-INDEPENDENT RADIATION CHARACTERISTICS

(75) Inventor: Per-Simon Kildal, Pixbo (SE)

(73) Assignee: Kildal Antenna Consulting AB, Pixbo (SE)

( * ) Notice: Subject to any disclaimer, the term of this patent is extended or adjusted under 35 U.S.C. 154(b) by 870 days.

(21) Appl. No.: 10/567,155

(22) PCT Filed: Aug. 9, 2004

(86) PCT No.: PCT/SE2004/001178

§ 371 (c)(1),
(2), (4) Date: May 8, 2008

(87) PCT Pub. No.: WO2005/015685

PCT Pub. Date: Feb. 17, 2005

(65) Prior Publication Data

US 2008/0204343 A1 Aug. 28, 2008

(51) Int. Cl.
*H01Q 11/10* (2006.01)

(52) U.S. Cl. ..... 343/792.5; 343/795

(58) Field of Classification Search ..... 343/792.5, 343/795

See application file for complete search history.

(56) References Cited

U.S. PATENT DOCUMENTS

| | | | | |
|---|---|---|---|---|
| 3,079,602 | A | 2/1963 | Hamel et al. | |
| 3,193,831 | A | 7/1965 | Yang | |
| 3,286,268 | A | 11/1966 | Barbano | |
| 3,500,424 | A * | 3/1970 | Barbano et al. | 343/792.5 |
| 3,543,277 | A | 11/1970 | Pullara | |
| 3,696,437 | A | 10/1972 | Grant | |
| 5,093,670 | A | 3/1992 | Braathen | |
| 5,274,390 | A | 12/1993 | Breakall | |
| 5,952,982 | A * | 9/1999 | Jorgenson et al. | 343/792.5 |
| 6,094,176 | A * | 7/2000 | Van Hoozen et al. | 343/792.5 |
| 6,285,336 | B1 * | 9/2001 | Zimmerman | 343/803 |
| 6,362,796 | B1 | 3/2002 | Bohlman | |
| 6,661,378 | B2 * | 12/2003 | Bloy | 342/437 |
| 6,731,248 | B2 * | 5/2004 | Killen et al. | 343/792.5 |
| 6,885,350 | B2 * | 4/2005 | Godard et al. | 343/792.5 |

FOREIGN PATENT DOCUMENTS

| | | |
|---|---|---|
| DE | 8104760 U1 | 9/1981 |
| EP | 0 644 607 | 3/1995 |
| GB | 983447 A | 2/1965 |

(Continued)

OTHER PUBLICATIONS

P.S. Excell et al: "Log-Periodic Antenna for Pulsed Radiation" Electronics Letters Oct. 15, 1998, vol. 34, No. 21, p. 1-2, figure 3.

(Continued)

*Primary Examiner* — Tan Ho

(74) *Attorney, Agent, or Firm* — Harness, Dickey & Pierce, P.L.C.

(57) ABSTRACT

The invention describes a broadband multi-dipole antenna that has low input reflection coefficient, low cross polarization, rotationally symmetric beam and constant beam width and phase center location over several octaves bandwidth. The dipoles are fed from one or a few feed points, and they may with advantage have log-periodic dimensions. The antenna is more compact, has lighter weight and is cheaper to manufacture than other solutions. It is very well suited for feeding single, dual or multi-reflector antennas.

29 Claims, 16 Drawing Sheets

FOREIGN PATENT DOCUMENTS

| | | |
|---|---|---|
| GB | 1 302 644 | 1/1973 |
| GB | 2 326 284 | 12/1998 |
| JP | 55-85107 | 6/1980 |
| JP | 58-6602 | 4/1983 |
| JP | 7-115380 | 5/1995 |
| JP | 8-335819 | 12/1996 |
| JP | 11-17438 | 1/1999 |
| JP | 11-168323 | 6/1999 |
| JP | 2000-165203 | 6/2000 |
| JP | 2002-353734 | 12/2002 |

OTHER PUBLICATIONS

English translation of Office Action issued Jun. 2, 2009 for corresponding Japanese Application No. 2006-522530.

Office Action dated Mar. 28, 2011 for corresponding European Patent Application No. EP 04 775 301.7.

G. Engargiola, "Non-Planar Log-Periodic Antenna Feed for Integration With a Cryogenic Microwave Amplifier", Proceedings of IEEE Antennas and Propagation Society international symposium, p. 140-143, 2002.

Jian Yang, et al., "Cryogenic 2-13 GHz Eleven Feed for Reflector Antennas in Future Wideband Radio Telescopes", Manuscript to tap special issue on antennas for next generation radio telescopes, pp. 1-17, Dec. 31, 2009.

R.H. DuHamel, et al., "Log Periodic Feeds for Lens and Reflectors", pp. 128-137, XP-001387070, IRE Nat. Conv. Rec., vol. 7, No. 1, Jan. 1, 1959.

* cited by examiner

BROADBAND MULTI-DIPOLE ANTENNA WITH FREQUENCY-INDEPENDENT RADIATION CHARACTERISTICS

This application is a National Phase entry of PCT Application no. PCT/SE2004/001178 filed on Aug. 9, 2004, which claims priority under 35 U.S.C. §§119(e), 120 and 365(c) to Swedish Patent SE 0302175-5, filed on Aug. 7, 2003.

FIELD OF THE INVENTION

The present invention relates to a broadband multi-dipole antenna, and in particular an antenna that has low input reflection coefficient, low cross polarization, rotationally symmetric beam and constant beam width and phase centre location over several octaves bandwidth.

BACKGROUND

Reflector antennas find a lot of applications such as in e.g. radio-link point-to-point and point-to-multipoint systems, radars and radio telescopes. Modern reflector antennas are often fed by different types of corrugated horn antennas. They have the advantage compared to other feed antennas that they can provide a rotationally symmetric radiation pattern with low cross polarization over a large frequency band. It is also possible with appropriate choice of dimensions to obtain a beam width that does not vary with frequency. Still, the bandwidth is normally limited to about an octave. Corrugated horns are also expensive to manufacture, in particular at low frequency where their physical size and weight become large.

Some reflector antennas are mass produced, in particular when they are small and up to about a meter in diameter, such as e.g. for application to satellite TV reception or as communication links between base stations in a mobile communication network. Even within radio astronomy there are proposals for radio telescopes that consist of several cheap mass produced antennas, such as the Allen telescope array (ATA) and the square kilometer array (SKA). ATA is already in the process of being realized in terms of mass produced large reflector antennas, and there exist similar realistic proposals for SKA. The requirement for bandwidth is incredible in both ATA and SKA, covering several octaves. In some proposed future mobile and wireless communication systems there are also requirements for antennas with large bandwidth. Such systems are often referred to as ultra wide band (UWB) systems and the broadband antenna technology as UWB antennas. As a result of the above there will be a need for new types of broadband antennas in the future, in particular antennas that can be used to feed reflectors in an efficient way.

There have recently been developed broadband feeds for reflectors that are much more broadband, lighter and cheaper to manufacture than corrugated horns. They have been obtained by locating four logperiodic antennas together in a pyramidal geometry, see Greg Engargiola "Non-planar log-periodic antenna feed for integration with a cryogenic microwave amplifier", Proceedings of IEEE Antennas and Propagation Society international symposium, page 140-143, 2002. The beam width is constant and the reflection coefficient at the input port is low over several octaves bandwidth. However, for known log-periodic antennas of this kind the phase centre moves with frequency. This causes problems with reduced directivity due to defocusing at most frequencies. Also, the known log-periodic pyramidal feed represents a rather complex mechanical solution.

SUMMARY OF THE INVENTION

It is therefore the purpose of the invention to provide an antenna that alleviates the above-mentioned drawbacks of previously known antennas. In particular, the antenna of the present invention is a relatively small and simple antenna, with at least one, and preferably all, of the following properties: constant beam width and directivity, low cross polarization as well as crosspolar sidelobes, low input reflection coefficient and constant phase centre location over a very large frequency band of several octaves. Typical numerical values are between 8 and 12 dBi directivity, lower than −12 dB crosspolar sidelobes, and, lower than −6 dB reflection coefficient at the antenna port. At the same time the antenna is preferably cheap to manufacture and has a light weight. This object is achieved with the antenna of the invention, as defined in the appended claims.

The antenna can be used to feed a single, dual or multi-reflector antenna in a very efficient way. However, the application is not limited to this. It can be used whenever a small, lightweight broadband antenna is needed, and in particular when there is a requirement that the beam width, directivity, polarisation or phase centre or any combination of these measures should not vary with frequency.

The basic component, from which the desired radiation characteristics of the antenna is constructed, is a pair of parallel dipoles, preferably located 0.5 wavelengths apart and about 0.15 wavelengths over a ground plane. This is known to give a rotationally symmetric radiation pattern according to e.g. the book Radiotelescopes by Christiansen and Högbom, Cambridge University Press, 1985. Such a dipole pair is also known to have its phase centre in the ground plane. However, the bandwidth is limited to the 10-20% bandwidth of a single dipole.

The broadband behaviour of the invention is obtained by locating several such dipole pairs of different sizes in such a way that their geometrical centres coincide. This means that the dipole pair operating at the lowest frequency is located outermost, and that the smaller higher frequency dipole pairs are located inside the outermost with the highest frequency pair in the innermost position. In addition there may be a set of similar, but orthogonally oriented, dipole pairs with the same geometrical centre to provide dual linear or circular polarization.

The present invention also provides an advantageous solution to feed the dipole pairs appropriately from one or a few feed points. This can according to the invention be done in many ways, as described in the patent claims and illustrated in the drawings. The two basic feeding techniques are also described in the next two paragraphs. The invention is not limited to these techniques.

The term wire is used in the description below. This term must not be taken literary, as it can also mean a conducting tube or strip as described in the patent claims.

A standard way to feed a dipole is to connect a two-wire feed line to a feed gap close to the centre of the dipole. By this method several neighbouring and parallel dipoles can be connected together with very short feed lines. Such feeding is known from U.S. Pat. No. 3,696,437, said document hereby incorporated by reference. In this feeding, the two wires of the feed line must cross each other between two neighbouring and parallel dipoles in order to function as intended. This means that the right wire that is connected to the right arm of the first dipole must be connected to the left arm of the second dipole, and thereafter to the right arm of the third dipole, and so on, and visa versa for the wire connected to the left arm of the first dipole. The two wires thereby have to cross each other without touching each other. This makes it difficult and cumbersome to realize the antenna mechanically with high precision, in particular at high frequency when the dimensions are small and the dipoles and wires preferably are made as metal patterns on one side of a thin dielectric substrate. Three of the two feeding techniques described in the present invention do not suffer from this disadvantage of crossing lines, as described in the two next paragraphs, respectively. The remaining feeding techniques, which are also part of the invention, have crossing wires but solve the problem associated with them in new ways.

The dipoles according to the invention can be made as folded dipoles, i.e. each dipole is made as two parallel wires connected together at their two outer ends. Such a folded dipole has, seen at a feed gap at the centre of one of the wires, an input impedance closer to that of the two-wire feed line than normal single-wire arms. Numerical experiments have shown that it is advantageous in the case of the invention to connect such parallel folded dipoles together by making a gap also at the centre of the second wire, and continue the two-wire line from this gap to the feed gap of the next neighbouring dipole. Thereby, neighbouring dipoles and their feed lines form two opposing serpentine-shaped wires. This feed method opens an extra possibility to tune the reflections at the input, by making each dipole arm consist of a two-wire inner part and a single-wire outer part, and adjusting the location of the transition from two-wire to single-wire line. The folded dipole feeding is also later described in connection with FIGS. 9 and 10, where it is shown that the input feeding port 6 of the antenna is in the centre at the smallest dipole.

It is also possible to feed dipoles from a single-wire line supporting a wave between the ground-plane and the line. This can be done by connecting together endpoints of neighbouring dipoles, in such a way that shorter high frequency dipoles act as feed lines for longer low frequency dipoles. Thereby, neighbouring dipoles and their feed lines form a single serpentine-shaped line. This is later described in connection with FIG. 8, where it is seen that the input feeding point of the antenna is in the centre.

The crossing wires of the feed line can also be avoided by locating the two wires of the feed line on opposite sides of a thin dielectric sheet and locating every second of the dipole arms on opposite sides of it as well, in such a way that the two arms of the same dipoles are located on opposite sides of the dielectric sheet. This will be further described in connection with FIG. 15. A similar feeding technique is known from e.g. U.S. Pat. No. 6,362,769, said document hereby incorporated by reference, but not in connection with the other parts of this invention.

As already mentioned the invention is not limited to the three feeding techniques described above and in FIGS. 8, 9 and 15. Other techniques encompassed by the present invention are e.g. described in connection with the descriptions of FIGS. 16, 17, 18 and 19. They all have crossing wires but makes the crossing in a well controlled manner suitable for mass production with high accuracy.

The invention makes use of a dipole pair as the basic building component. This does not necessarily mean that two such dipoles are connected together mechanically to one unit, e.g. by locating them on the same thin dielectric substrate, in such a way that if one is removed the other is removed as well. On the contrary, the dipole pair is only a basic electromagnetic building component when we construct the radiation pattern from electric current sources, i.e., we need two equal dipoles that radiate at the same frequency and are spaced about 0.5 wavelengths apart to get the desired rotationally symmetric radiation pattern. Actually, the dipoles on one side of the geometrical centre will normally be mechanically connected by their feed lines, so that removing one of the dipoles of a pair will mean that we at the same time remove one of the dipoles of all the pairs. The connected dipoles may also be located on the same supporting material, such as a dielectric substrate.

The dipoles in the description are normally thought of as being straight and about half a wavelength long. However, they may also be V-shaped or slightly curved or serpentined, as long as the radiation pattern gets a rotationally symmetric beam at the frequency of radiation of the considered dipole pair.

U.S. Pat. No. 6,362,796 describes an antenna with zig-zag shaped dipoles similar to the invention. This antenna is, however, not located above a ground plane and is therefore not used to provide a beam in one direction with a high directivity. Also, the feeding shown in this US patent is not of the type specified in the invention. There dipoles are not folded as in FIGS. 7 and 8, or they are not connected via their endpoints as in FIG. 6. Also, the feed points of the 4 dipole chains are at the outer largest dipoles rather than in the centre at the smallest dipoles.

The dipoles and feed lines can be realized as wires, tubes, or thin metal strips. They can also be etched out from a metal layer on a dielectric substrate. They can also be located on both sides of one or more thin dielectric layers, e.g. the dipoles on one side and the feed lines on the other side, or part of the dipoles and feed lines on one side and the rest on the other side.

The different feed lines must be correctly excited in such a way that the radiating currents on the two dipoles of the same dipole pair are excited with the same phase, amplitude and direction.

U.S. Pat. No. 5,274,390 describes a phased antenna array including log-periodic antennas above a ground plane. However, it is clear from our description above that the invention is not a phased array antenna, but rather that each dipole chain is excited so that the dipoles of each dipole pair radiate with the same phase.

The present application describes a broadband multi-dipole antenna that has several advantages over the prior art, such as simultaneous low input reflection coefficient, low cross polarization, low crosspolar sidelobes, rotationally symmetric beam and almost constant directivity, beam width and phase centre location over several octaves bandwidth. Further, the dipoles are fed from one or a few centrally located feed points, and they may with advantage have log-periodic dimensions.

The antenna is more compact, has lighter weight and is cheaper to manufacture than other solutions. It is very well suited for feeding single, dual or multi-reflector antennas.

The centrally located feed area may contain a balun or a 180 deg hybrid which provides a transition from a coaxial line to the two opposite directed two-wire lines feeding opposite located dipole chains. The balun may be active, meaning that it is combined with a receiver or transmitter circuit. In the case of a dual polarized antenna there need to be two such baluns or 180 deg hybrids located in the central area. The baluns or 180 deg hybrids can also be located behind the ground plane.

DRAWINGS

DETAILED DESCRIPTION OF THE FIGURES

The invention will now be described in more detail with reference to preferred embodiments. However, it should be understood that different features in the specific embodiments are, unless otherwise stated, exchangeable between the embodiments. Further, all embodiments relate to locating the radiating dipole parts of a multi-dipole antenna in such a way that the radiation pattern gets rotational symmetry with low cross polarization and a frequency independent beam width over a large bandwidth.

Figure 1:
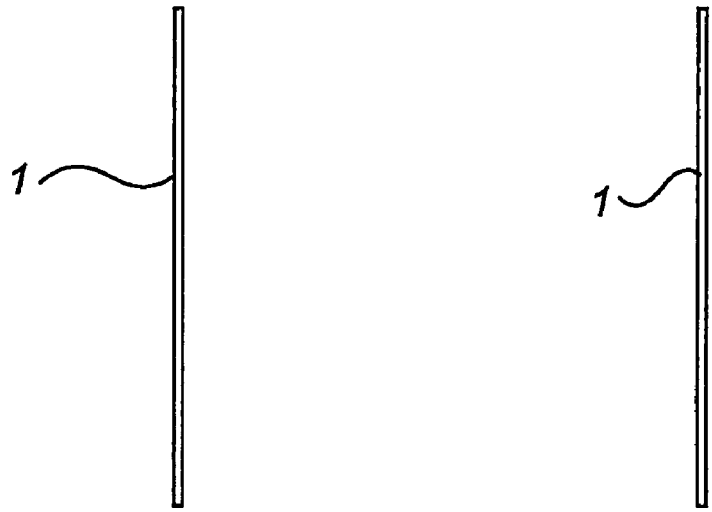
FIG. 1 shows the top view of a dipole pair according to an embodiment of the invention, functioning as a basic component of the invention.

The dipole pair in FIG. 1 is the basic component of the invention. If the two dipoles 1 are about 0.5 wavelengths long and located with a spacing of about 0.5 wavelengths about 0.2 wavelengths above a ground plane, the radiation pattern of the dipole pair unit has rotational symmetry with low cross polarization, provided the currents on the two dipoles have the same direction, amplitude and phase. The height over ground plane can be chosen within the interval 0 and 0.3 wavelengths, whereas the length and spacing typically must be within +/−0.2 wavelengths.

Figure 2:
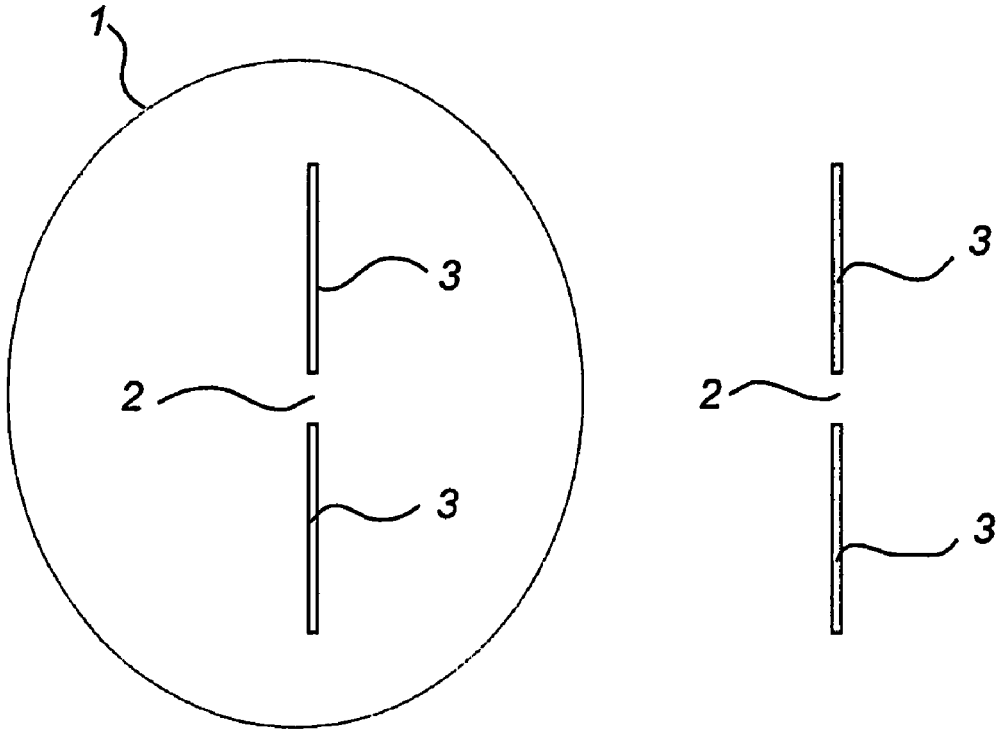
FIG. 2 shows the top view of a dipole pair with fed gaps according to an embodiment of the invention, functioning as a basic component of the invention.
Figure 3:
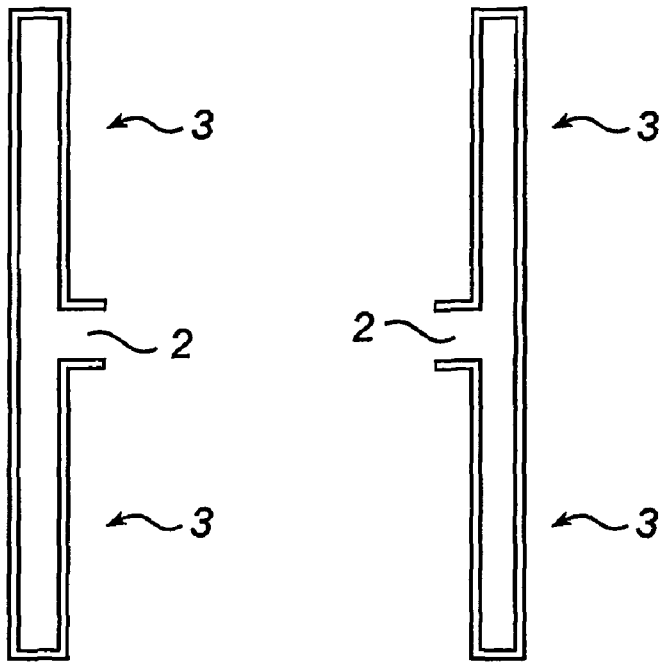
FIGS. 3 and 4 show top views of a dipole pair realized as so-called folded dipoles with fed gaps according to an embodiment of the invention, functioning as a basic component of the invention.
Figure 4:
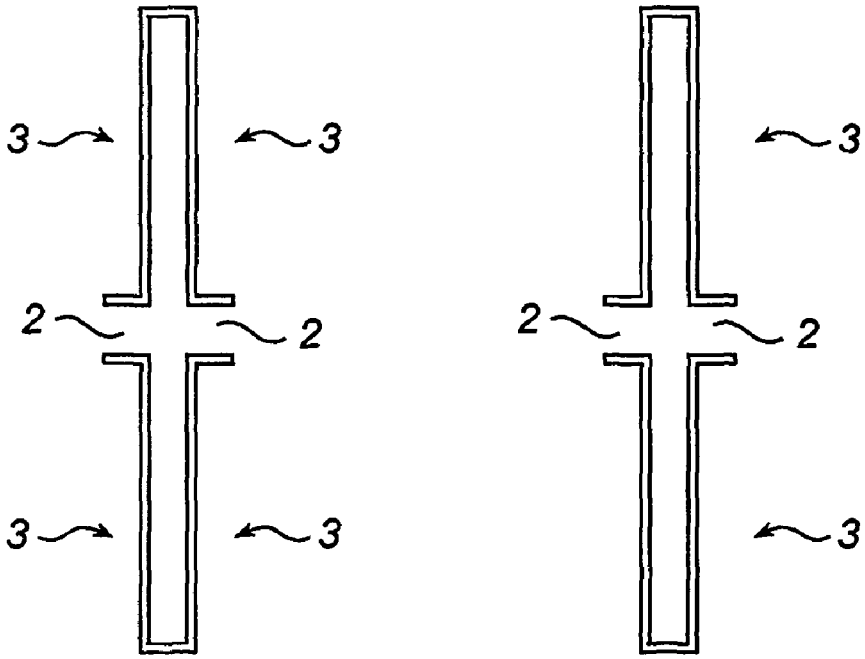

A dipole antenna preferably has a feed gap 2 in the center so that two dipole arms 3 are formed, as shown in FIG. 2. The dipoles can also be realized as a folded dipoles as shown in FIGS. 3 and 4. Each folded dipole in FIG. 3 is realized as one single wire that is folded twice, once to the left and then to the right, so that the left fold makes up the left dipole arm 3 and the right fold makes up the right one 3. The folded dipoles in FIG. 4 have completely separated arms with no wire connection between them, so that it appears to have two feed gaps 2. The feeding of the dipole versions in FIGS. 1, 2, 3 and 4 will be described in connection with FIGS. 8, 9, 10, 15, 16, 17, 18 and 19.

Figure 5:
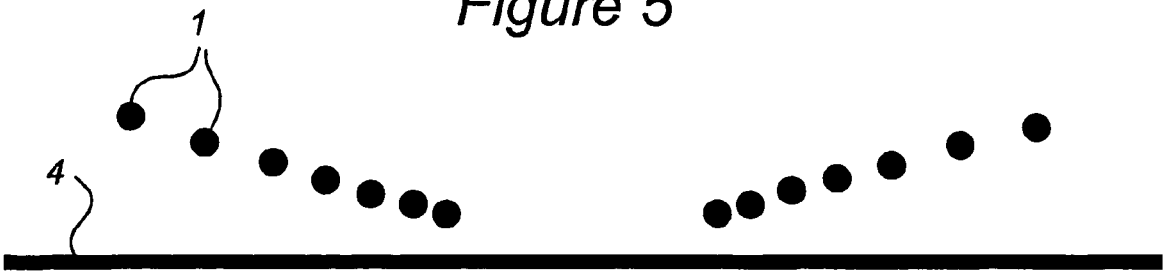
FIG. 5 shows a top view of multiple dipole-pairs arranged for providing linear polarization, according to an embodiment of the invention.

Several dipole pairs 1 can be arranged as shown in FIG. 5 to provide broadband linearly polarized radiation. The feeding of the dipoles can be done in many different ways, as will be described later. The main point is that they have to be fed in such a way that the currents on the dipoles of each dipole pair have the same direction, amplitude and phase.

Figure 6:
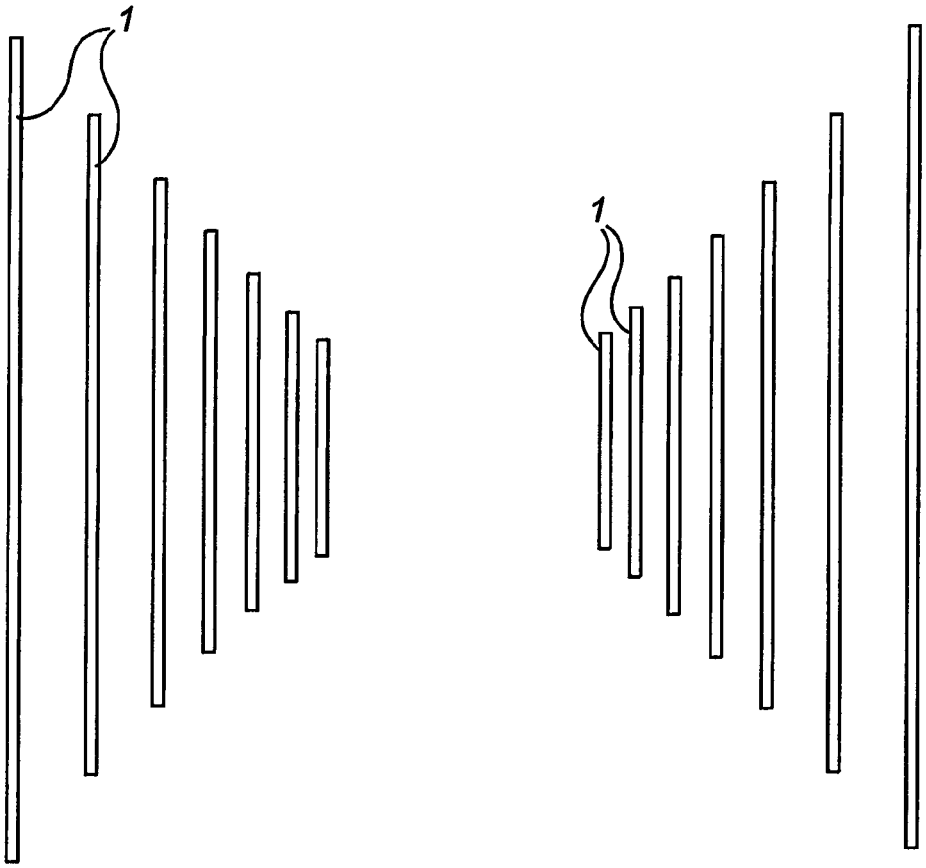
FIG. 6 shows a cross section of multiple dipole pairs located above a ground plane and arranged for providing linear polarization, according to an embodiment of the invention.

The dipoles 1 of the invention are preferably located above a ground plane 4 as shown in FIG. 6, but in some applications this may not be necessary. The ground plane is in the figure shown to be flat and plane, whereas in some applications it may be desirable and possible to make it slightly conical, pyramidal, doubly curved or any other shape deviating from a plane.

Figure 7:
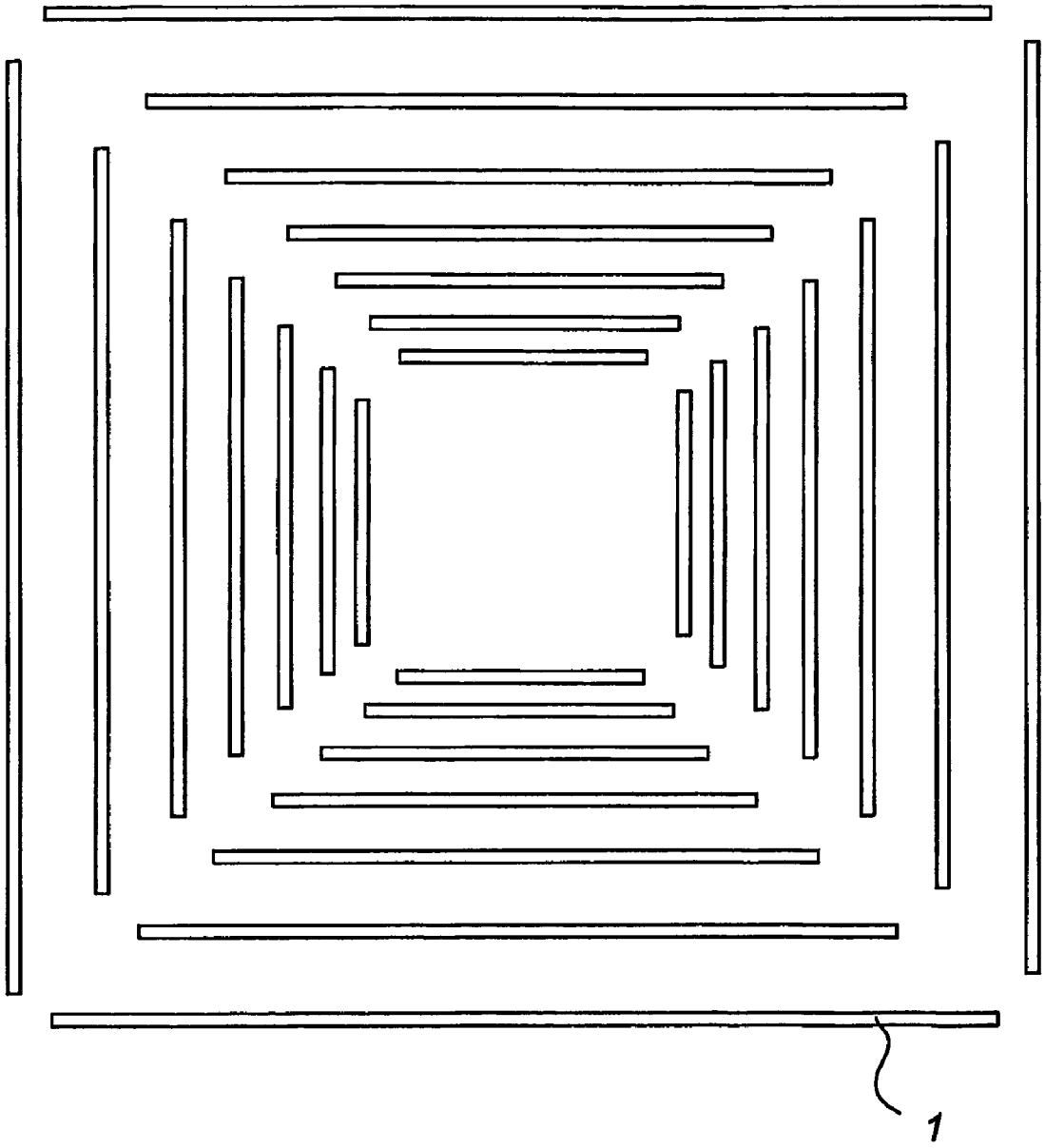
FIG. 7 shows a top view of multiple dipole pairs arranged for providing dual linear or circular polarization, according to an embodiment of the invention.

An antenna according to the invention can also be used for dual linear or circular polarization. In such cases the dipole pairs must be arranged as shown in FIG. 7. There exist for each dipole pair an orthogonal dipole pair having the same dimensions. The feeding of the dipoles are within each quadrant of the geometry the same as for one half of the linearly polarized version in FIG. 6.

The dipoles in FIGS. 5, 6 and 7 are shown without a feed gap, but they can equally well have a feed gap. They are also shown without feed lines and supporting material. In reality, they will have feed lines, e.g. as shown in FIG. 8, 9, 10, 11, 12, 13, 14, 15, 16, 17, 18 or 19. In reality there will also often be a supporting material between the dipoles and the ground plane, such as a dielectric substrate or a foam material. This can also take the form of one or more thin dielectric sheet on which the dipoles are located.

Figure 8:
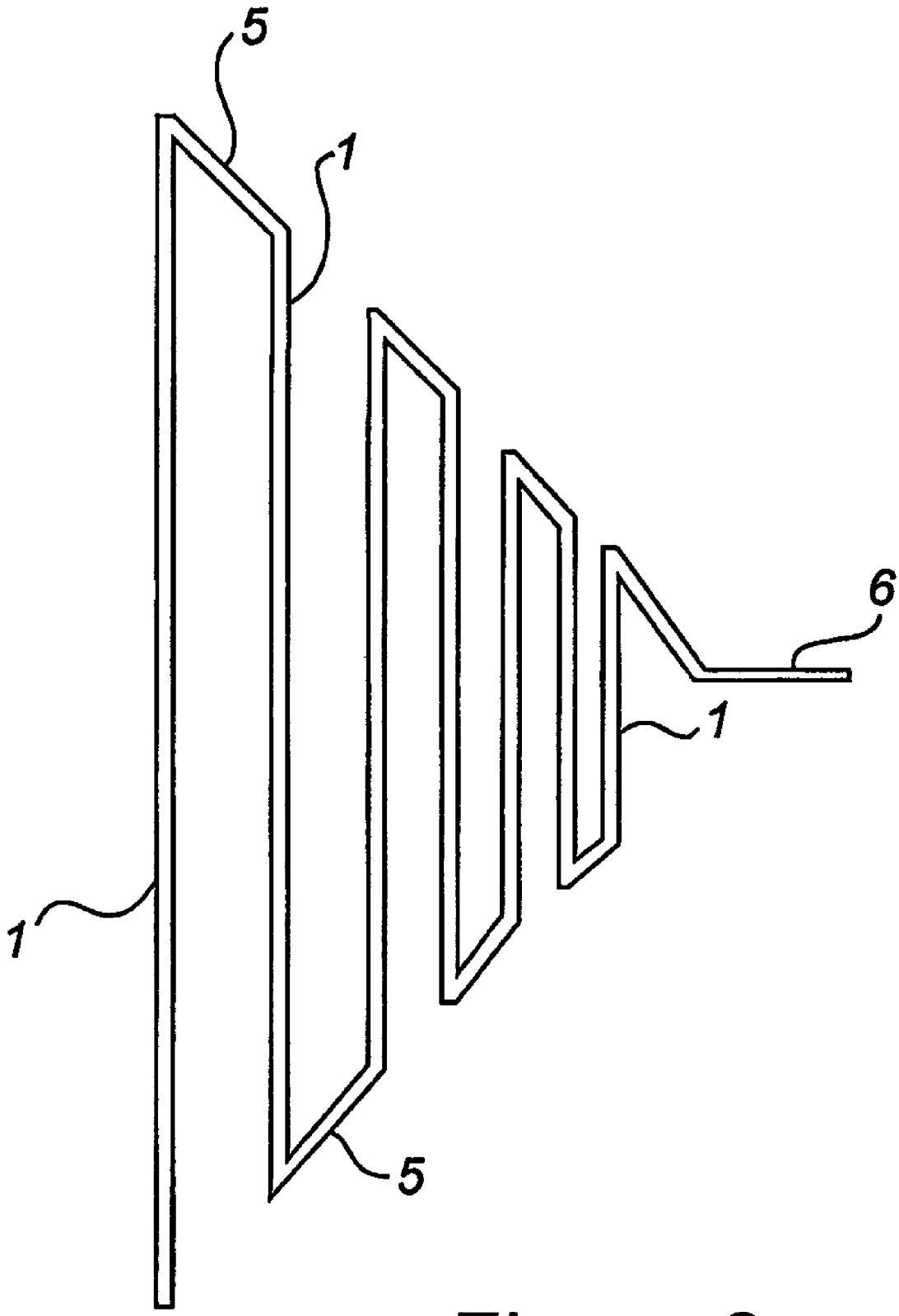
FIG. 8 shows a top view of the left part of multiple dipole pairs with included feed connections between dipole ends, according to an embodiment of the invention.

FIG. 8 shows how the dipoles of the left half of the antenna in FIG. 6 can be connected with conducting joints 5 between their ends according to the invention. In this embodiment, the dipoles and joints can be realized by the same wire, propagating a feed voltage between the wire and the ground plane from the feed point 6 to all the dipoles.

Figure 9:
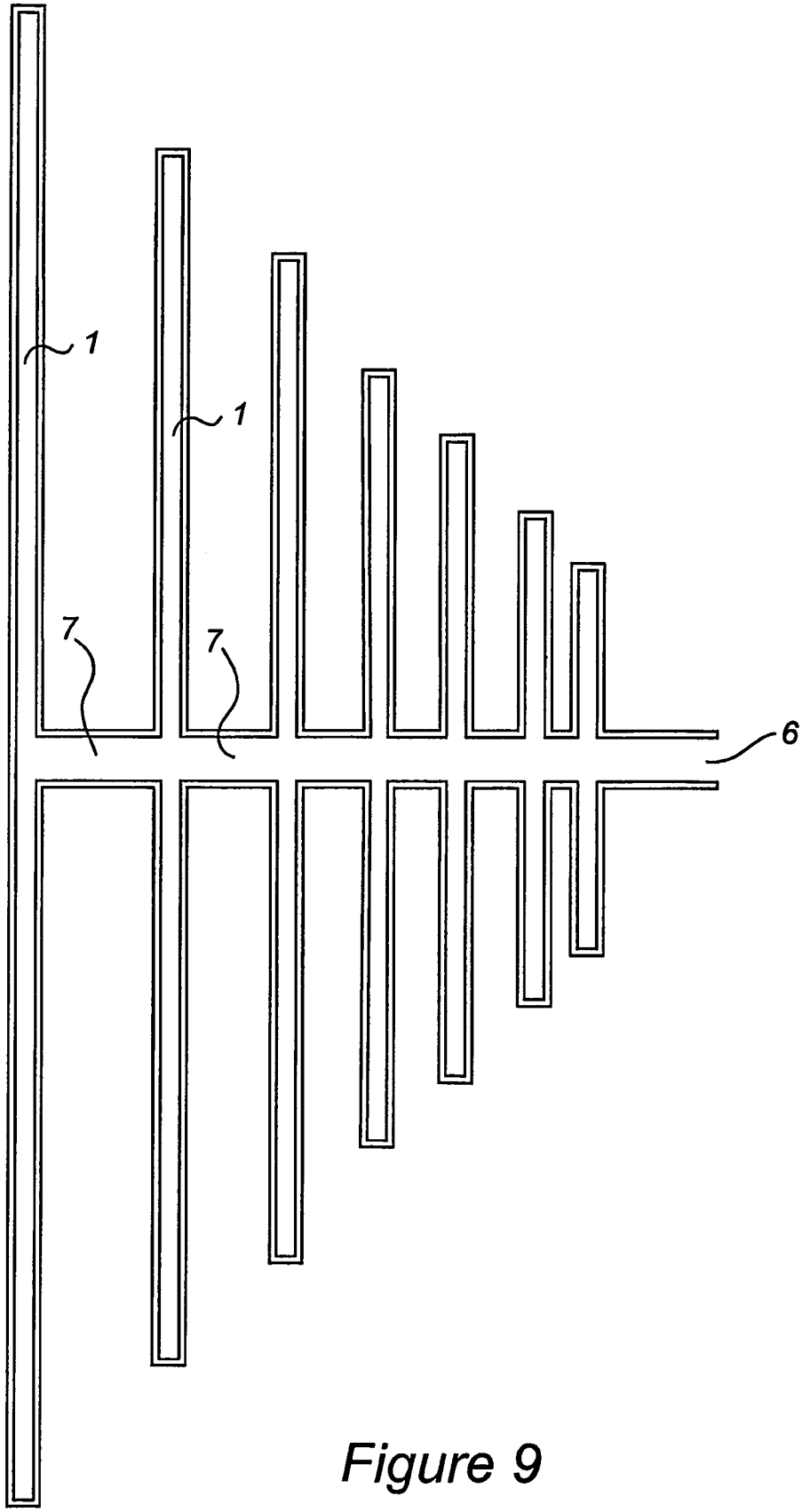
FIGS. 9 and 10 show a top view of the left part of multiple dipole pairs realized as folded dipoles with included a feed line between the feed gaps of the dipoles, according to an embodiment of the invention.

In FIG. 9 dipoles are realized as so-called folded dipoles of the kind shown in FIG. 4, i.e. each dipole is made of two parallel wires connected at their both ends. A folded dipole can be fed by a two-wire line connected to the feed gap 2 in one of these wires. In the invention, there is also a gap in the second wire of each dipole as shown in FIG. 4, at which a new two-wire line 7 is connected and continuing to the feed gap of the next neighbouring dipole. Thereby, two opposing serpentine lines running from the feed point 6 are created, exciting all dipoles by a propagating wave.

Figure 10:
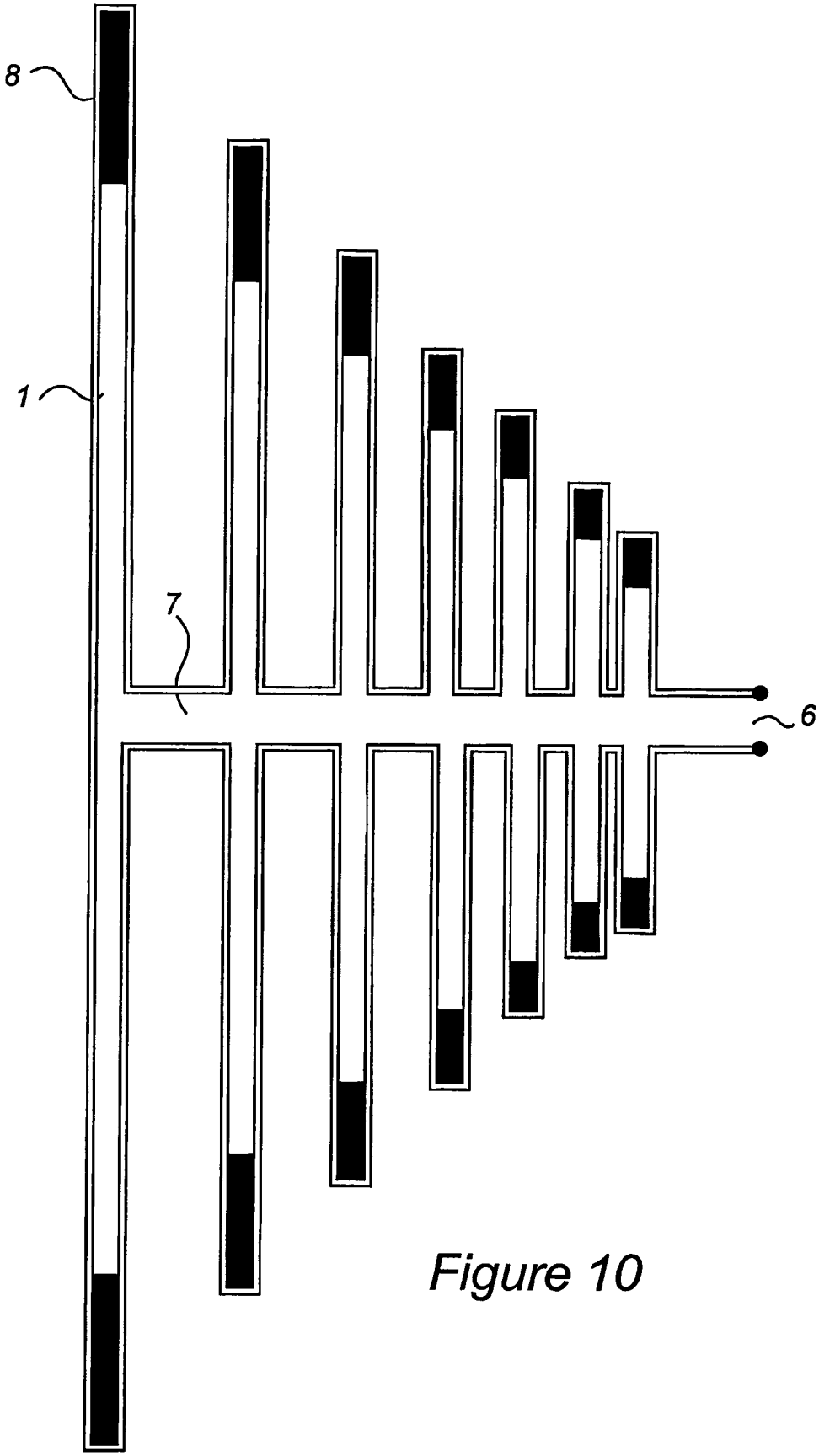
Figure 11:
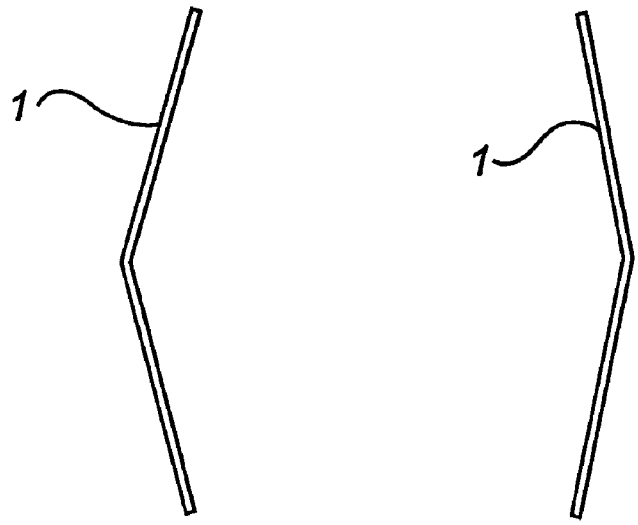
FIGS. 11 and 12 show alternative embodiments of the dipole pair, which is the basic component of the invention.
Figure 12:
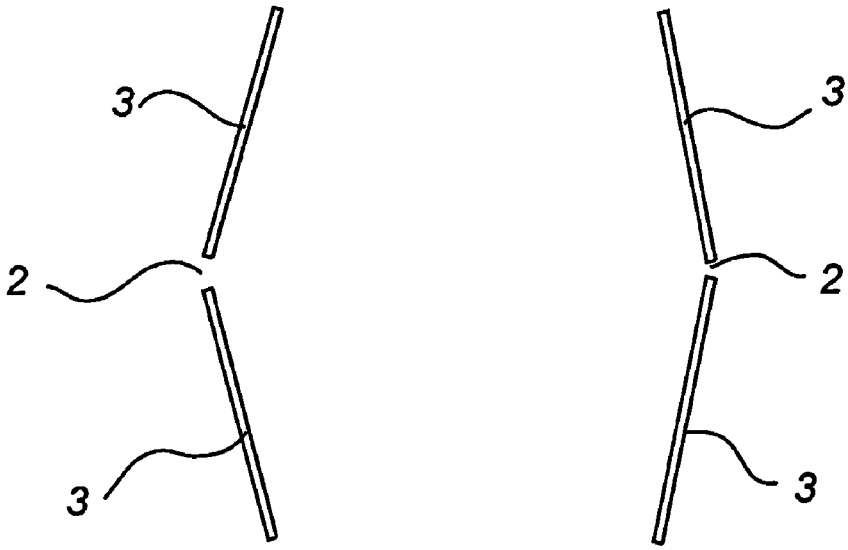

FIG. 10 shows also a realization in terms of folded dipoles. However, the two-wire lines making up the dipoles arms are shortened at their ends, so that the radiating dipole length is longer than the length of its folded two-wire part.

Figure 13:
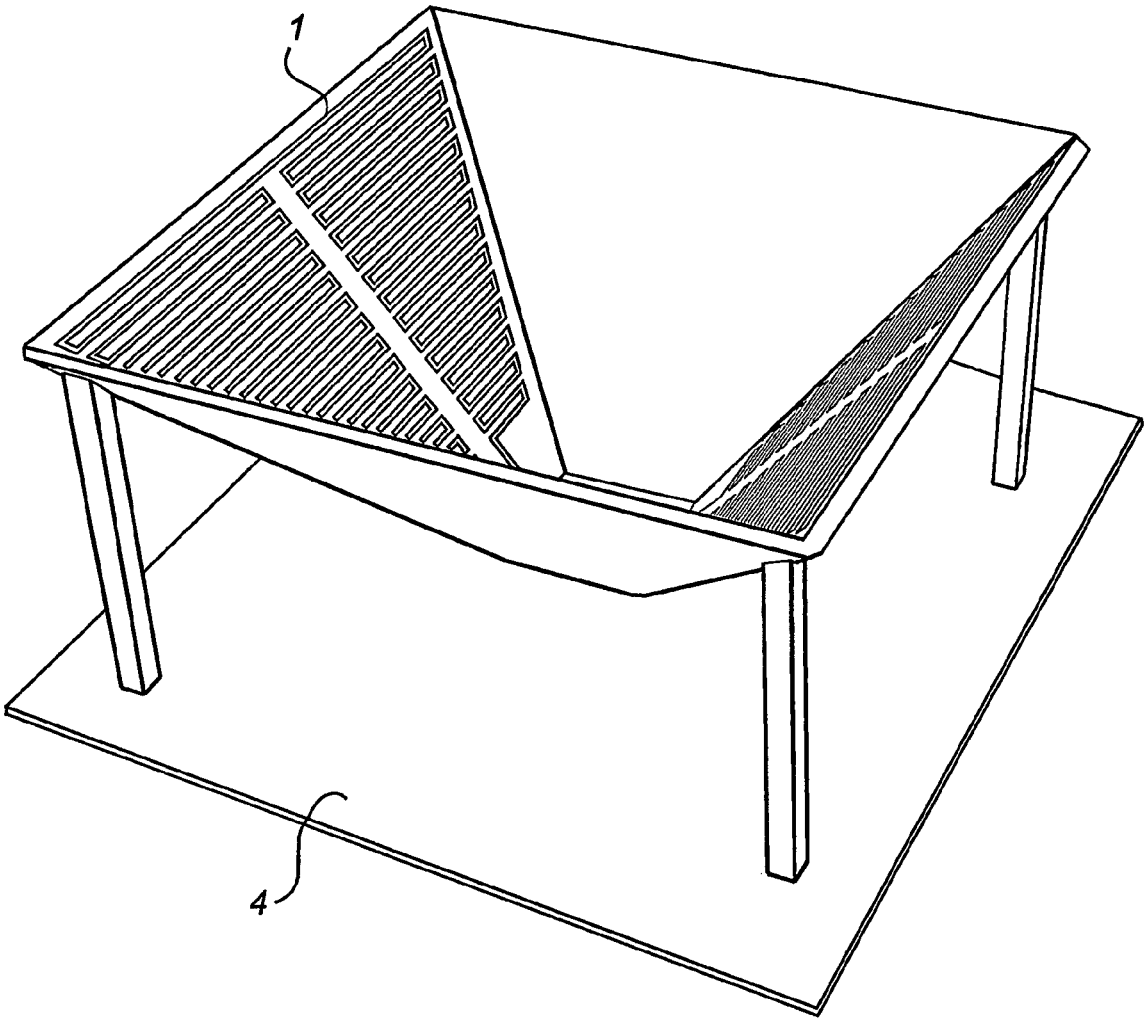
FIGS. 13 and 14 illustrates in perspective two embodiments of the antenna according to the invention, with a single and double polarisation, respectively.
Figure 14:
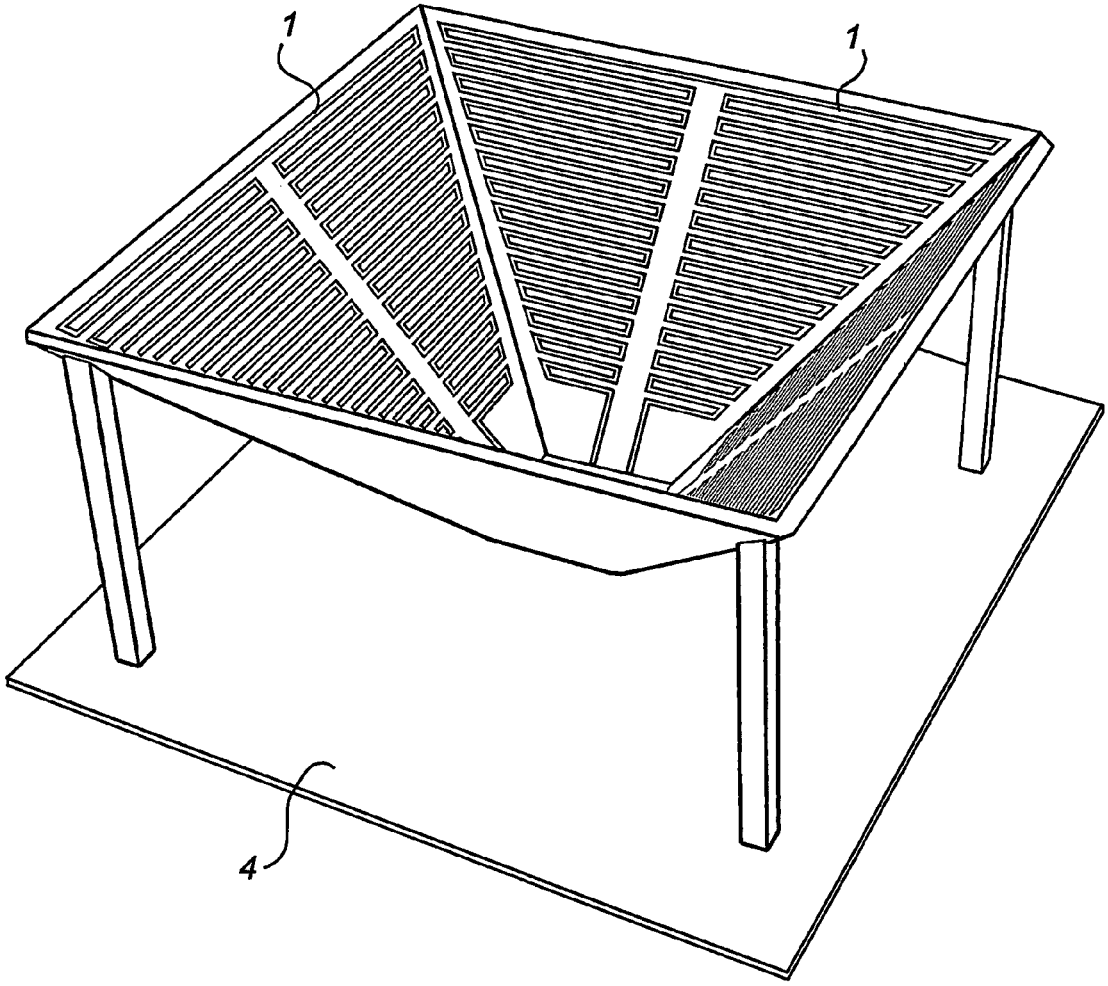

FIGS. 13 and 14 illustrates in perspective two embodiments of an antenna. In FIG. 13, the dipoles are provided on two antenna plates arranged on a ground plate. The antenna plates are arranged in a slanted disposition relative to each other, so that the functional antenna elements of the antenna plate's are facing each other. The antenna of FIG. 13 is a single polarisation antenna.

The antenna of FIG. 14 resembles the antenna of FIG. 13, but it has four rather than two antenna plates arranged in a slanted disposition relative to each other, so that the functional antenna elements of the antenna plates are in pairs facing each other. The antenna of FIG. 14 is a double polarisation antenna.

The embodiments in FIGS. 13 and 14 show two respectively four antenna plates facing each other. However, the invention is not limited to such realizations. In particular, such antenna plates on which the dipoles are etched, milled or otherwise located may be lying beside each other in the same plane, or there may be one plane antenna plate containing all dipoles rather than two or four plates.

In FIGS. 6 to 10 the antennas according to the invention makes use of dipoles of 7 different dimensions. This number is arbitrarily chosen, as the antenna can consist of any number of dipole pairs of different dimensions, smaller, larger or much larger than 7. Also, the spacing between neighbouring dipoles is arbitrarily chosen. It can be smaller or larger dependent on the results of the optimization of the design.

The drawings in the figures show multi-dipole antennas where the dimensions of the different dipole pairs appear to vary approximately log-periodically. This means that the dimensions of all dipole pair are scaled relative to the dimensions of the closer inner pair of each of them by the same constant factor. This is done in order to provide an environment for each dipole pair that looks the same independent of whether it has large dimensions for operation at some of the lowest frequencies or small dimensions for operation at some of the highest frequencies. This log-periodic scaling is not necessary, although it is expected to give the best and most continuous broadband performance. In particular, this log-periodic choice of dimensions may not be needed if multi-band instead of broadband performance is asked for.

It is according to the invention possible to provide the antenna with several feed points, even within one quadrant of the antenna. With a quadrant we mean in this case the geometry in FIG. 8, 9, 10 or 11. Such a quadrant makes up half a linearly polarized version of the complete antenna as shown in FIG. 3, and it makes up one quarter of a complete dual linear or circularly polarized antenna as shown in FIG. 7. If a quadrant has several feed points, it means that quadrants of different sizes are located besides each other so that they form a new complete and much more broadband antenna, but that the bandwidth is divided between the separate feed points.

Feeding of the dipoles could be provided in various ways, as is indicated in the foregoing discussion. Other further advantageous feeding systems will now be discussed in more detail. These feeding systems may also be used in the previously discussed embodiments, as complements or alternatives to the already disclosed feeding systems.

The following feeding systems are particularly advantageous for dipoles comprising strips etched or milled on a thin dielectric sheet. It is preferred to feed the dipoles in each pair by two different two-wire feed lines, both of which originate at a common port in the center between the innermost dipoles. Embodiments of such feeding systems are illustrated in FIG. 15-19.

Figure 15A:
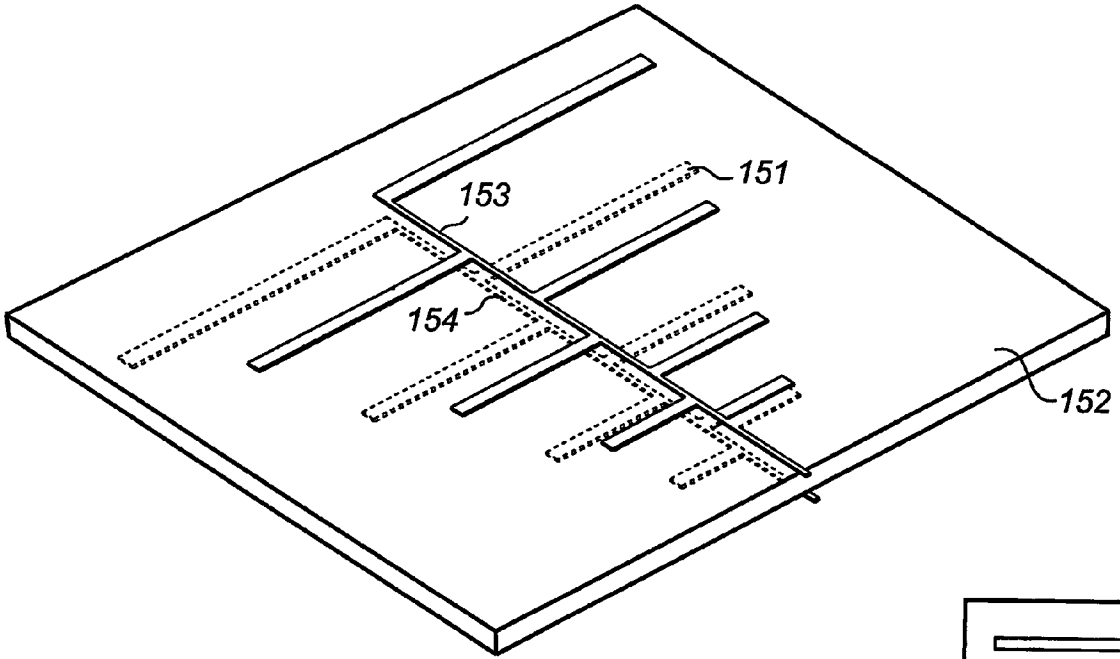
FIGS. 15-20 show the left part of further embodiments of antennas according to the invention, with different feed line arrangements. The figures show only one half of a linearly polarized antenna according to the invention, or one quarter of a circularly polarized realization of the antenna.
Figure 15B:
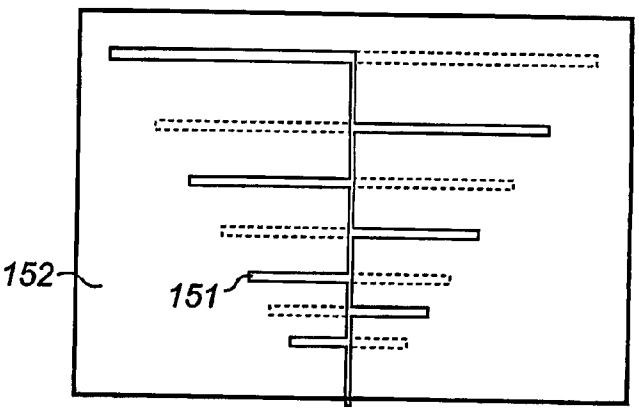

In the embodiment illustrated in FIG. 15, dipoles 151 are arranged as strips on opposite sides of a thin substrate 152. FIG. 15*a* illustrates the antenna in a perspective view, whereas FIG. 15*b* illustrates the same antenna in a plain view from above. In each dipole, one of the arms is arranged on one side of the substrate and the other on the opposite side. Further, the arms of successive dipoles are arranged on alternating sides of the substrate. In the figures, the continuous lines illustrate the conducting parts formed on the upper side of the substrate, whereas the dashed lines illustrate the conducting parts formed on the lower side of the substrate.

The feed line consists of two separate conducting strips, one strip 153 arranged on the upper side of the substrate and the other 154 on the lower side. The upper feed strip is connected to the dipole arms on the upper side, and the strip on the lower side is connected to the dipole arms there, thereby exciting the dipoles in the desired manner.

The antenna according to this embodiment could preferably be realised by means of e.g. etching or milling of a printed card board (PCB).

Consequently, the antenna according to this embodiment has dipole arms and feed strips arranged on opposite sides of the substrate. The substrate is preferably relatively thin, in order to avoid any significant alteration of the antenna performance due to this separation of the dipole arms in the thickness direction of the substrate.

Figure 16:
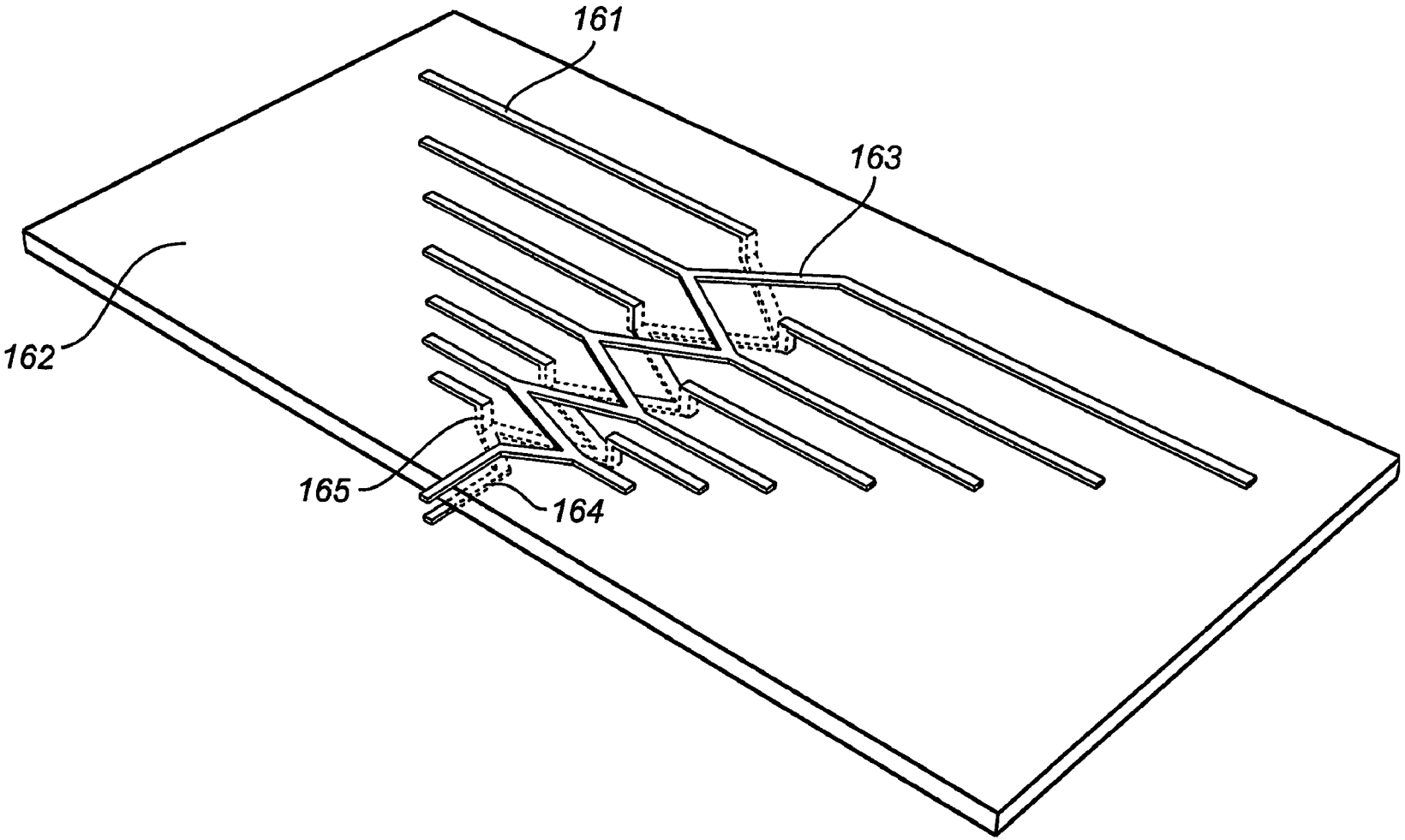

In the embodiment illustrated in FIG. 16, all dipoles 161 are arranged as conducting strips on the same side of a substrate 162. This is advantageous to reduce cost of manufacturing. The feed line consists of two conducting strips or wires, one on each side of the substrate.

The first wire is arranged on the upper side of the substrate, and connected to one arm of each dipole, and more specifically successively to dipole arms on alternating sides of the centre line through the feed gaps of the dipoles. Accordingly, the feeding line 163 preferably has a zigzag shape, and it is preferably etched or milled from a metal cover on the supporting dielectric sheet in the same way as the dipoles. As in the embodiment of FIG. 15, a second wire is provided on the opposite lower side of the substrate. However, in the embodiment of FIG. 16, this second wire is connected by means of connection wires 165 penetrating the substrate to the dipole arms on the upper side of the substrate. This second wire is hereby connected to the dipole arms not connected to the first wire. Accordingly, in the same way as in the embodiment of FIG. 15, every second dipole arm is excited from opposite wires of the feed line.

The antenna according to this embodiment could preferably also be realised by means of e.g. etching on a printed card board (PCB). The wire on the lower side can be realized by etching as well, and with vias making the connections 165 through the dielectric sheet, or it can be realized by a several pieces of thin wires which are bent and shaped to be soldered to the connection points of the dipole arms. Then, there will also be holes in the substrate at the connection points, and the endpoints of the wires pieces will be inserted into these holes and soldered to the dipole arms. The wire pieces could then be located not only on the lower side of the substrate, but also on the upper side of it, at sufficient distance above the etched conducting strips of the upper wire of the transmission line.

Figure 17:
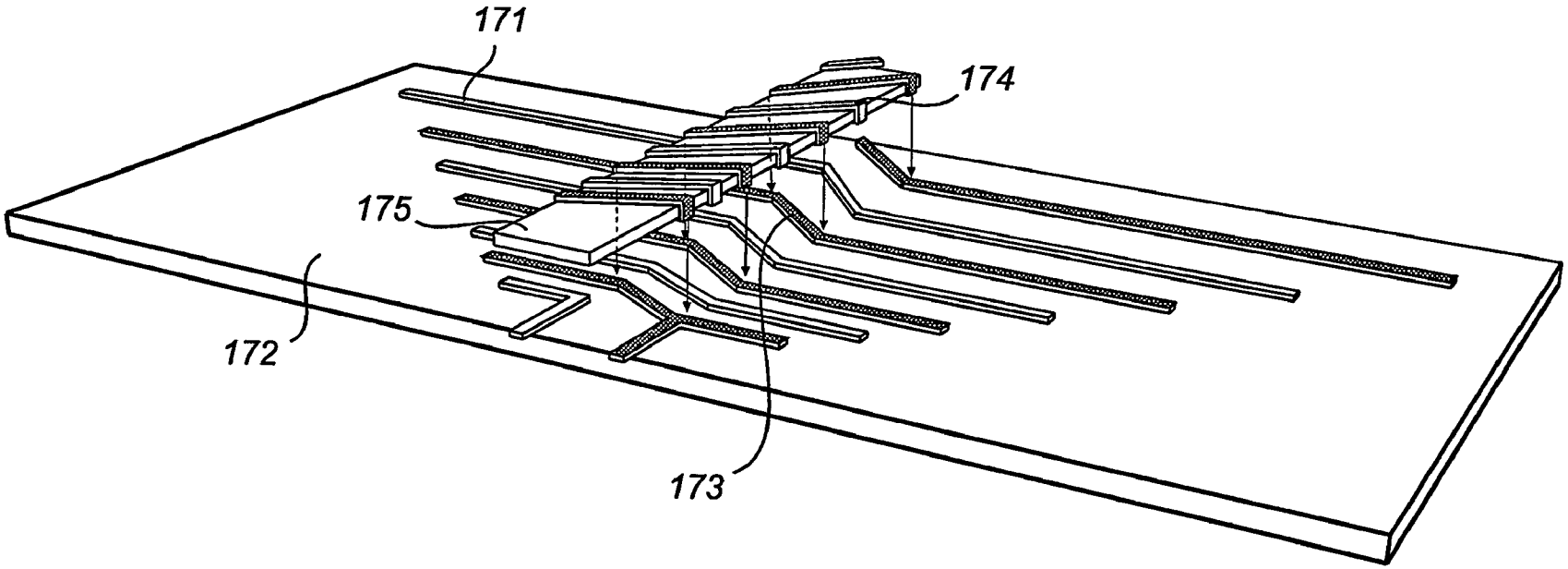

In the embodiment illustrated in FIG. 17, all dipole arms 171 are arranged as strips on the same side of a substrate 172. The right arm of any dipole is connected with a conducting strip 173 to the left arms of the next neighbouring dipole, so that the strips look like dipoles with two bends and no feed gap. A thin dielectric plate 175 is located above the centre of the dipoles, having conducting strips 174 connecting the left arm of any dipole to the right arms of the next neighbouring dipole. The connections to the dipole arms is preferably made with soldering or similar. The output result of this embodiment is similar to result obtained in the embodiments discussed in relation to FIGS. 15 and 16.

Figure 18:
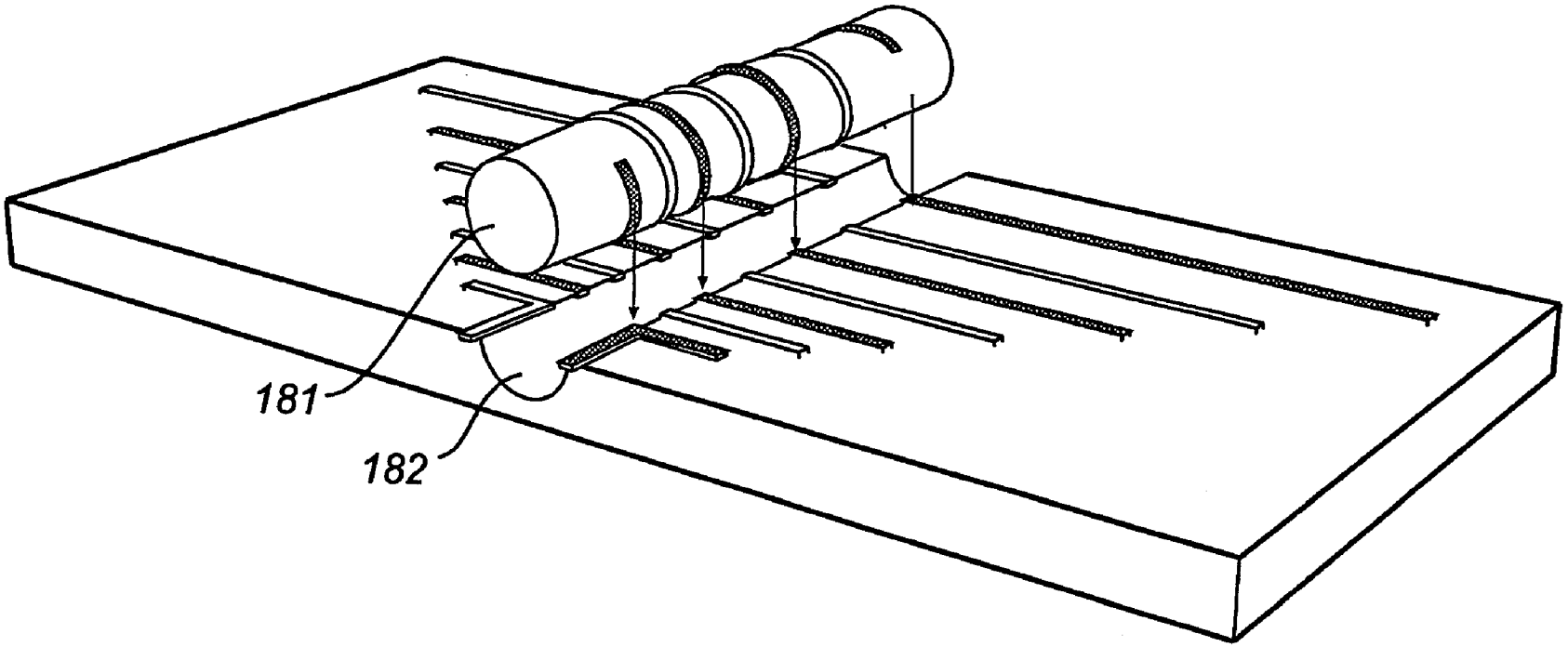

In an alternative embodiment, illustrated in FIG. 18, a circular dielectric rod 161 with two wires that are wound in spiral around the rod. The two wires forms the feed line connecting the dipole arms in the desired manner. In order to obtain the intended connection to the dipole arms, the substrate could in this case be provided with a groove or channel 182. The antenna according to this embodiment could preferably also be realised by means of e.g. etching on a printed card board (PCB).

Figure 19:
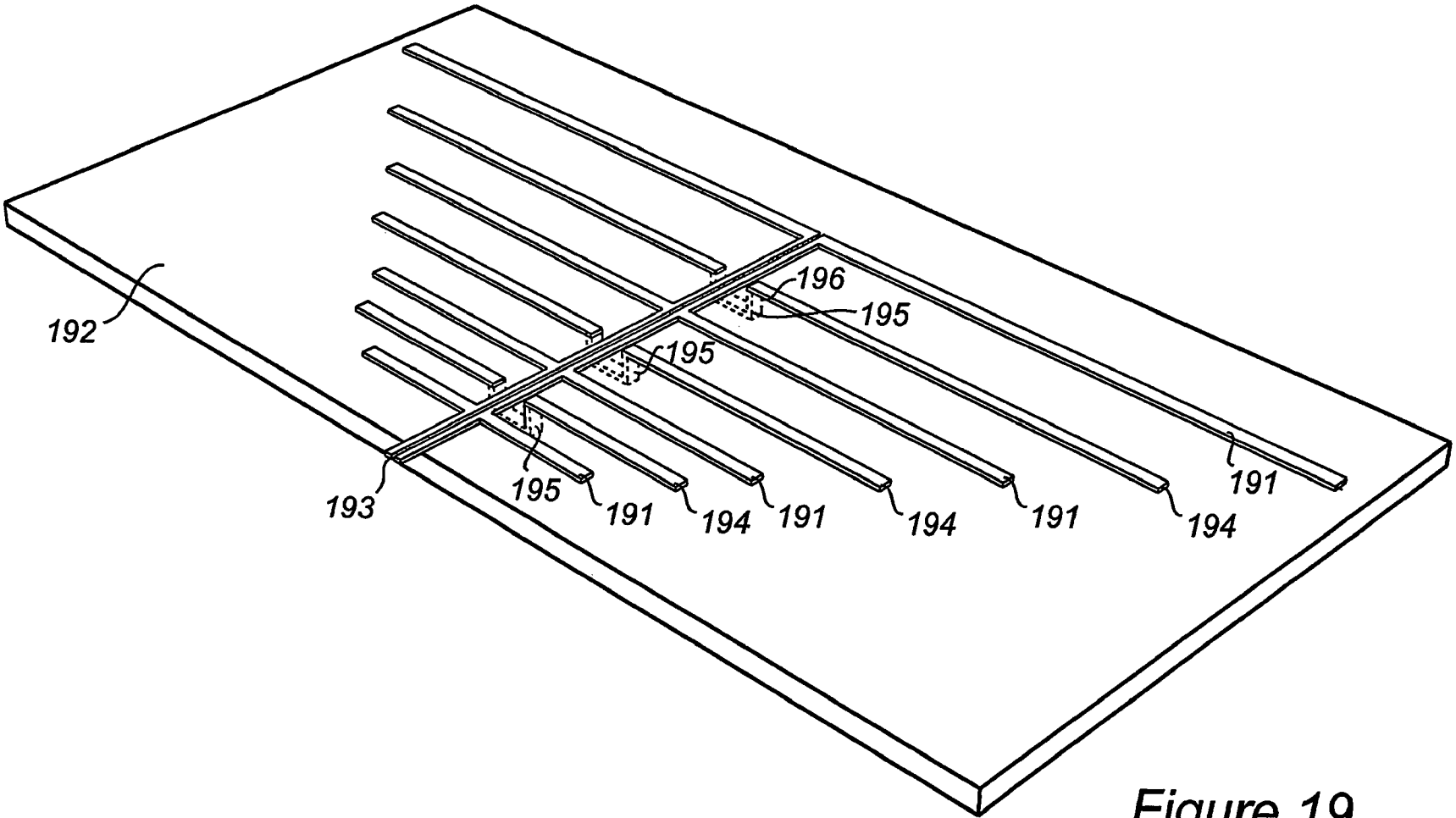

Another alternative embodiment is illustrated in FIG. 19. In this embodiment, every second pair of dipoles 191 are provided on a first side of a supporting substrate 192, and are fed by a feed line 193 arranged on the same side of said substrate.

The arms 194 of the other pairs of dipoles are arranged between said dipoles 191 fed by the feed line. The two arms 194 of each other dipoles are connected together by means of a wire 195 located under the substrate as shown in FIG. 19, but this wire could also be located above the substrate 192 provided it makes no metal contact with the feed line 193 or any of the dipoles 191 connected to this two-wire line. In this embodiment every second dipole 194 is excited indirectly by mutual near-field coupling to the neighbouring dipoles 191 that are excited directly from the feed line 193.

Figure 20:
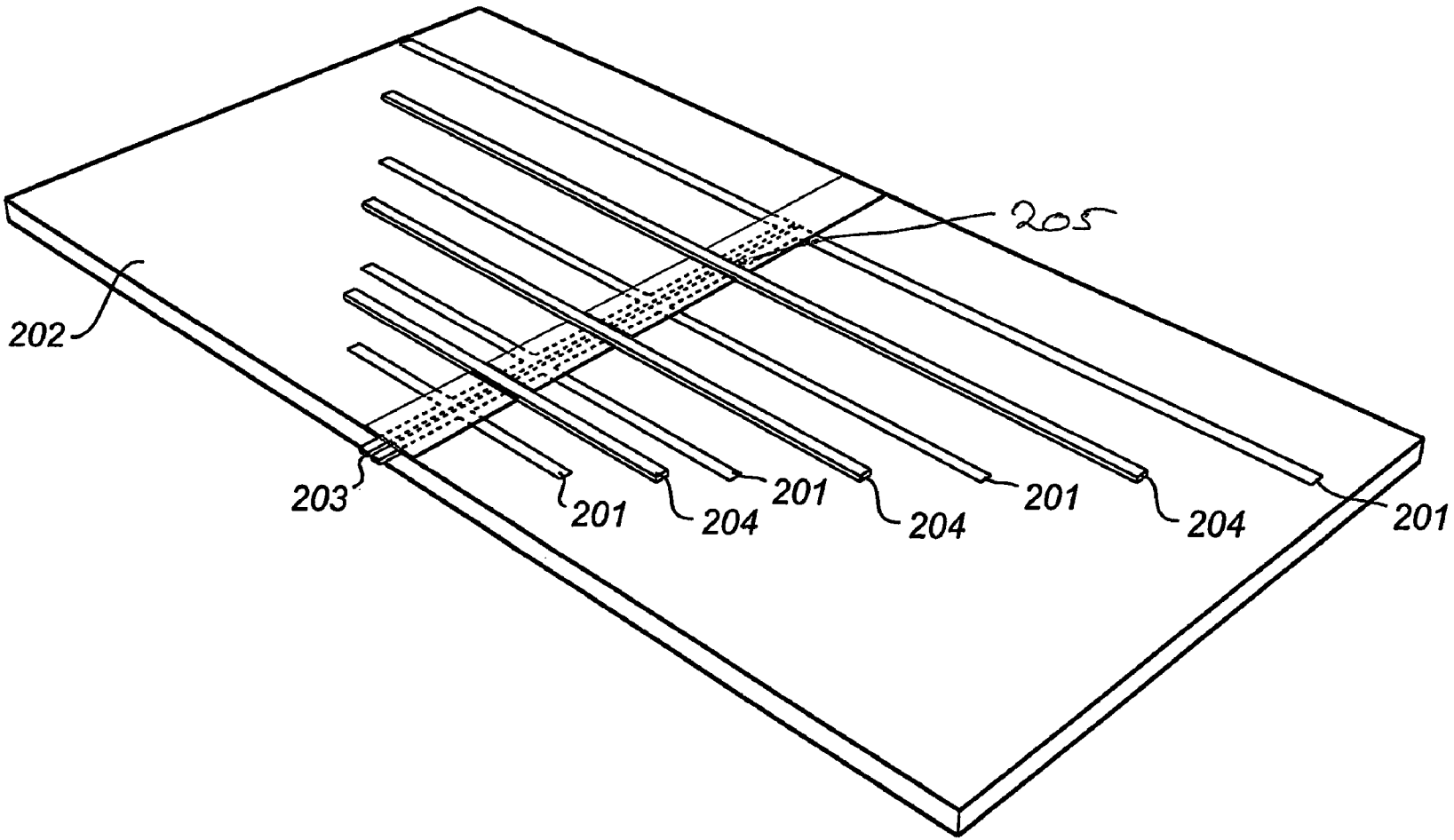

In another alternative, illustrated in FIG. 20, the other dipoles 204 may be arranged on the same side of the substrate as the dipoles 201, whereby no penetration of the substrate is necessary. The dipoles 204 are then also excited by mutual coupling. A sheet of insulting material could e.g. be arranged between the feed line 203 and the centre of the dipoles 204 in order avoid metal contact between the two in the crossings 205. However, other ways of avoiding such contact are also feasible. The dipoles 204 could also be entirely located on a separate thin substrate located on top of the layer of dipoles 201.

The above-discussed embodiments of antennas according to the invention have many features in common. For example, all, or at least most, of said embodiments encompass the following features:

- The antennas comprise dipoles arranged in pairs, which is evident from FIGS. 6 and 7. FIGS. 8, 9, 10, 13, 14, 15, 16, 17, 18, 19, 20 show only one half of a linearly polarized antenna according to the invention, or one quarter of a circularly polarized realization of the antenna.
- The antenna dipoles are arranged on one side of a ground plane, and in such a way that the main lobe of the output radiation pattern is directed in a direction perpendicular to said ground plane.
- The lengths of the dipoles (antenna elements) increase along the feed line away from a centrally located feed point. The length of succeeding dipoles preferably differ in length from the dipole positioned immediately before by a frequency-independent factor. The factor is preferably in the range 1.1-1.2.
- The spacings between the dipoles increases along the feed line away the centrally located feed point as well, by a constant frequency-independent factor. The factor is preferably in the range 1.1-1.2.
- The two (linearly polarized version) or four (dual polarized version) parts of the antenna are fed by separate feed lines that are connected to common feed point or feed points in the central region between the antenna parts.
- The antenna elements/dipoles are essentially formed as straight conducting wires or strips.
- The antenna elements are formed on supporting dielectric substrates, such as PCBs, and preferably by means of etching techniques, as is per se known in the art.
- The antennas could be used for a wide range of different output wavelengths, and is particularly useful for wavelengths in the range 1-15 GHz, and most particularly for the ultra wideband range (2-10 GHz).

Specific embodiments of the invention have now been described. However, several alternatives are possible, as would be apparent for someone skilled in the art. For example, different arrangement designs of the dipoles are possible, different combination of antenna planes are possible, various feeding arrangements are feasible, etc.

Such and other obvious modifications must be considered to be within the scope of the present invention, as it is defined by the appended claims. It should be noted that the above-mentioned embodiments illustrate rather than limit the invention, and that those skilled in the art will be able to design many alternative embodiments without departing from the scope of the appended claims.

The invention claimed is:

1. An antenna for at least one of transmitting and receiving electromagnetic waves, comprising:

a plurality of pairs of electric dipoles, each pair of dipoles being parallel with respect to each other and oppositely located thereof, wherein each dipole includes two or more conducting lines that are connected at one or more point or an extended part of the conducting lines, and the dipole of each pair of dipoles provides at least one of radiating and receiving with approximately the same amplitude and phase, at least some of said plurality of pairs of dipoles have different properties and the dipoles being arranged in such a way that geometrical center of each pair of dipoles are at least approximately coinciding; and a conducting body acting as a ground plane, above which the plurality of pairs of dipoles are located, wherein approximately half the plurality of pairs of dipoles are oriented in one direction and the rest in an orthogonal direction, in order to at least one of transmit and receive waves of at least one of dual linear polarization and circular polarization.

2. An antenna for at least one of transmitting and receiving electromagnetic waves, comprising:

a plurality of pairs of electric dipoles, each pair of dipoles being parallel with respect to each other and oppositely located thereof, wherein each dipole includes two or more conducting lines that are connected at one or more point or an extended part of the conducting lines, and the dipole of each pair of dipoles provides at least one of radiating and receiving with approximately the same amplitude and phase, at least some of said plurality of pairs of dipoles have different properties and the dipoles being arranged in such a way that geometrical center of each pair of dipoles are at least approximately coinciding;

a conducting body acting as a ground plane, above which the plurality of pairs of dipoles are located; and metal lines connecting neighboring dipoles of each pair of dipoles, the metal lines do not cross each other.

3. An antenna for at least one of transmitting and receiving electromagnetic waves, comprising:

a plurality of pairs of electric dipoles, each pair of dipoles being parallel with respect to each other and oppositely located thereof, wherein each dipole includes two or more conducting lines that are connected at one or more point or an extended part of the conducting lines, and the dipole of each pair of dipoles provides at least one of radiating and receiving with approximately the same amplitude and phase, at least some of said plurality of pairs of dipoles have different properties and the dipoles being arranged in such a way that geometrical center of each pair of dipoles are at least approximately coinciding; and a conducting body acting as a ground plane, above which the plurality of pairs of dipoles are located, wherein the conducting body located under the plurality of pairs of dipoles and acting as the ground plane is non-flat.

4. An antenna for at least one of transmitting and receiving electromagnetic waves, comprising:

a plurality of pairs of electric dipoles, each pair of dipoles being parallel with respect to each other and oppositely located thereof, wherein each dipole includes two or more conducting lines that are connected at one or more point or an extended part of the conducting lines, and the dipole of each pair of dipoles provides at least one of radiating and receiving with approximately the same amplitude and phase, at least some of said plurality of pairs of dipoles have different properties and the dipoles being arranged in such a way that geometrical center of each pair of dipoles are at least approximately coinciding; and a conducting body acting as a ground plane, above which the plurality of pairs of dipoles are located, wherein the dipoles are at least one of V-shaped and curved.

5. An antenna for at least one of transmitting and receiving electromagnetic waves, comprising:

a plurality of pairs of electric dipoles, each pair of dipoles being parallel with respect to each other and oppositely located thereof, wherein each dipole includes two or more conducting lines that are connected at one or more point or an extended part of the conducting lines, and the dipole of each pair of dipoles provides at least one of radiating and receiving with approximately the same amplitude and phase, at least some of said plurality of pairs of dipoles have different properties and the dipoles being arranged in such a way that geometrical center of each pair of dipoles are at least approximately coinciding; and a conducting body acting as a ground plane, above which the plurality of pairs of dipoles are located, wherein the antenna is used to illuminate at least one of a single, a dual and a multi reflector antenna system.

6. The antenna according to claim 5, wherein the plurality of pairs of dipoles are oriented in one direction in order to at least one of transmit and receive waves of one linear polarization.

7. The antenna according to claim 5, wherein the dipoles are made of at least one of conducting wires, tubes and strips.

8. The antenna according to claim 5, wherein the dipoles are made by conducting strips on a dielectric substrate.

9. The antenna according to claim 5, wherein at least one dipole comprises two oppositely directed conducting arms with a feed gap therebetween.

10. The antenna according to claim 9, wherein the feed gaps of the neighboring dipoles of different dipole pairs are excited by two-conductor feed lines starting from at least one feed point.

11. The antenna according to claim 5, wherein each dipole includes two opposite arms, and each dipole arm includes two conducting lines that are connected at an outer end whereas an inner end at a feed gap is connected with the inner end of the closest line of at least one of a neighboring inner and outer dipole arm, so that one set of dipoles with feed lines are formed by two opposing serpentine-shaped lines.

12. The antenna according to claim 5, wherein the dimensions of each dipole pair have a dipole length of approximately 0.5 wavelength, a dipole height over ground between 0.05 and 0.30 wavelength, and a dipole spacing of approximately 0.5 wavelength, where the wavelength is for a frequency of which a given dipole pair is the dominating contributor of radiation pattern.

13. The antenna according to claim 5, wherein dimensions of different dipole pairs varies in a log-periodic manner in order to make a very broadband overall performance.

14. The antenna according to claim 5, wherein radiation patterns have an almost constant beam width over a very wide frequency band that may be several octaves.

15. The antenna according to claim 5, wherein for at least some of the dipole conducting arms are arranged on opposite sides of a substrate, and wherein a separate conductor of a two-conductor feed line is arranged on each side for exciting the dipole conducting arms arranged on said sides.

16. The antenna according to claim 5, wherein most of dipole conducting arms are arranged on one side of a substrate, and conductors of a feed line are winded in parallel on a dielectric rod so that different windings of the lines are connected to different dipole conducting arms.

17. An antenna for at least one of transmitting and receiving electromagnetic waves, comprising:

a plurality of pairs of electric dipoles, each pair of dipoles being parallel with respect to each other and oppositely located thereof, wherein each dipole includes two or more conducting lines that are connected at one or more point or an extended part of the conducting lines, and the dipole of each pair of dipoles provides at least one of radiating and receiving with approximately the same amplitude and phase, at least some of said plurality of pairs of dipoles have different properties and the dipoles being arranged in such a way that geometrical center of each pair of dipoles are at least approximately coinciding; and a conducting body acting as a ground plane, above which the plurality of pairs of dipoles are located, wherein the dipoles are excited by connecting together the endpoints of neighboring parallel dipoles of each pair of dipoles so as to form serpentine-shaped lines.

18. An antenna for at least one of transmitting and receiving electromagnetic waves, comprising:

a plurality of pairs of electric dipoles, each pair of dipoles being parallel with respect to each other and oppositely located thereof, wherein each dipole includes two or more conducting lines that are connected at one or more point or an extended part of the conducting lines, and the dipole of each pair of dipoles provides at least one of radiating and receiving with approximately the same amplitude and phase, at least some of said plurality of pairs of dipoles have different properties and the dipoles being arranged in such a way that geometrical center of each pair of dipoles are at least approximately coinciding; and a conducting body acting as a ground plane, above which the plurality of pairs of dipoles are located, wherein at least one balun is arranged in a central region between the plurality of pairs of dipoles.

19. The antenna according to claim 18, wherein at least one of the balun and a 180 deg hybrid is realized as an active circuit including transistor amplifiers.

20. The antenna according to claim 18, wherein the plurality of pairs of dipoles are located above the conducting body, wherein at least one of the balun and a 180 deg hybrid is located behind the ground plane in the central region with transmission lines providing a connection through the ground plane.

21. An antenna for at least one of transmitting and receiving electromagnetic waves, comprising:

a plurality of pairs of electric dipoles, each pair of dipoles being parallel with respect to each other and oppositely located thereof, wherein each dipole includes two or more conducting lines that are connected at one or more point or an extended part of the conducting lines, and the dipole of each pair of dipoles provides at least one of radiating and receiving with approximately the same amplitude and phase, at least some of said plurality of pairs of dipoles have different properties and the dipoles being arranged in such a way that geometrical center of each pair of dipoles are at least approximately coinciding; and a conducting body acting as a around plane, above which the plurality of pairs of dipoles are located, wherein at least one 180 deg hybrid is arranged in a central region between plurality of pairs of dipoles.

22. An antenna for at least one of transmitting and receiving electromagnetic waves, comprising:

a plurality of pairs of electric dipoles, each pair of dipoles being parallel with respect to each other and oppositely located thereof, wherein each dipole includes two or more conducting lines that are connected at one or more point or an extended part of the conducting lines, and the dipole of each pair of dipoles provides at least one of radiating and receiving with approximately the same amplitude and phase, at least some of said plurality of pairs of dipoles have different properties and the dipoles being arranged in such a way that geometrical center of each pair of dipoles are at least approximately coinciding; and a conducting body acting as a ground plane, above which the plurality of pairs of dipoles are located, wherein at least one dipole includes two oppositely directed conducting arms with a feed gap therebetween, and wherein the feed gaps of neighboring dipoles of different dipole pairs are excited by a two-conductor feed line starting from at least one feed points, the two separate conductors of the two-conductor feed line being arranged in at least two different, non-intersecting planes.

23. The antenna according to claim 22, wherein the two-conductor feed line comprise a first conductor in a first plane, and a second conductor at least partly arranged in a second plane, said first and second planes being different and non-intersecting to each other.

24. The antenna according to claim 23, wherein at least part of the dipole conducting arms are arranged in said first plane.

25. The antenna according to claim 23, wherein the dipoles are made by conducting strips on a dielectric substrate, and wherein the first and second planes are arranged on different sides of said substrate.

26. An antenna for at least one of transmitting and receiving electromagnetic waves, comprising:

a plurality of pairs of electric dipoles, each pair of dipoles being parallel with respect to each other and oppositely located thereof, wherein each dipole includes two or more conducting lines that are connected at one or more point or an extended part of the conducting lines, and the dipole of each pair of dipoles provides at least one of radiating and receiving with approximately the same amplitude and phase, at least some of said plurality of pairs of dipoles have different properties and the dipoles being arranged in such a way that geometrical center of each pair of dipoles are at least approximately coinciding; and a conducting body acting as a ground plane, above which the plurality of pairs of dipoles are located, wherein the plurality of pairs of dipoles are arranged on one side of a substrate, and a first conductor of a two-conductor feed line is arranged on the same side thereof, whereas a second conductor of said two-conductor feed line is arranged at least partly on an opposite side of the substrate, and being connected to the dipoles through the substrate.

27. The antenna according to claim 26, wherein the second conductor connects dipoles within at least some of the dipole pairs to each other, said dipole pairs thereby being excited by electromagnetic coupling to neighboring dipoles.

28. An antenna for at least one of transmitting and receiving electromagnetic waves, comprising:

a plurality of pairs of electric dipoles, each pair of dipoles being parallel with respect to each other and oppositely located thereof, wherein each dipole includes two or more conducting lines that are connected at one or more point or an extended part of the conducting lines, and the dipole of each pair of dipoles provides at least one of radiating and receiving with approximately the same amplitude and phase, at least some of said plurality of pairs of dipoles have different properties and the dipoles being arranged in such a way that geometrical center of each pair of dipoles are at least approximately coinciding; and a conducting body acting as a ground plane, above which the plurality of pairs of dipoles are located, wherein at least some of the plurality of pairs of dipoles have dipoles being connected to separate feed lines.

29. The antenna according to claim 28, wherein at least some neighboring plurality of pairs of dipoles are connected to separate feed lines.

* * * * *

UNITED STATES PATENT AND TRADEMARK OFFICE

CERTIFICATE OF CORRECTION

PATENT NO. : 8,130,162 B2
APPLICATION NO. : 10/567155
DATED : March 6, 2012
INVENTOR(S) : Per-Simon Kildal It is certified that error appears in the above-identified patent and that said Letters Patent is hereby corrected as shown below:

Title Page, insert Item (30):

-- Foreign Application Priority Data

Aug. 7, 2003 (SE) ..... 0302175-5

June 18, 2004 (WO) ..... PCT/SE2004/000988 --.

Signed and Sealed this
Twenty-ninth Day of May, 2012

David J. Kappos

David J. Kappos
*Director of the United States Patent and Trademark Office*